US005590646A

United States Patent [19]

Murphy

[11] Patent Number: 5,590,646

[45] Date of Patent: Jan. 7, 1997

[54] EMERGENCY SAFETY MASK

[76] Inventor: Frank C. Murphy, 4703 Crest Oak Rd., Austin, Tex. 78744

[21] Appl. No.: 572,635

[22] Filed: Dec. 14, 1995

[51] Int. Cl.[6] ..... A62B 9/00

[52] U.S. Cl. ..... 128/206.19; 128/201.23; 128/201.24; 128/205.25; 128/206.12; 128/206.21; 128/206.27; 128/206.28

[58] Field of Search ..... 128/201.13, 201.17, 128/201.22, 201.23, 201.24, 201.25, 206.21, 207.11, 205.25, 206.12, 206.19, 206.22, 206.27, 206.28

[56] References Cited

U.S. PATENT DOCUMENTS

| | | | |
|---|---|---|---|
| 1,079,251 | 11/1913 | Macrini | 128/201.23 |
| 2,775,967 | 1/1957 | Sovinsky | 128/207.11 |
| 2,810,385 | 10/1957 | Reed | 128/201.23 |
| 3,249,108 | 5/1966 | Terman | 128/204.17 |
| 4,665,566 | 5/1987 | Garrow | 128/201.22 |
| 4,974,605 | 12/1990 | Esqueda | 128/206.21 |
| 5,010,594 | 4/1991 | Suzuki et al. | 128/201.13 |
| 5,245,993 | 9/1993 | McGrady et al. | 128/201.22 |
| 5,406,943 | 4/1995 | Hubbard et al. | 128/201.17 |
| 5,483,956 | 1/1996 | Shapiro | 128/206.21 |

FOREIGN PATENT DOCUMENTS

| | | | |
|---|---|---|---|
| 749920 | 5/1933 | France | 128/201.23 |
| 860879 | 10/1940 | France | 128/201.23 |
| 472897 | 9/1937 | United Kingdom | 128/207.11 |

*Primary Examiner*—V. Millin
*Assistant Examiner*—V. Srivastava
*Attorney, Agent, or Firm*—Martin Sachs

[57] ABSTRACT

An emergency safety mask includes a flexible porus material capable of readily absorbing liquids and passing air therethrough, elongated elastic generally formed as the letter "X" and joined at the intersection thereof is affixed to the flexible porus material, with two arms of the "X" affixed to the upper portion of the material and two arms being adapted to be affixed to the lower portion of the material, forming a flexible circularly-shaped band adapted to be placed over the head of a user. Each of the upper bands includes a clip device as part of the affixing mechanism suitable for retaining a miniature source of light (flashlight), and a second clip device removably retains a frangible liquid container.

8 Claims, 1 Drawing Sheet

EMERGENCY SAFETY MASK

BACKGROUND OF THE INVENTION

1. Field of the Invention

The present invention relates to filter masks, which cover both the mouth and nostrils of the wearer from the surrounding environment, and more particularly, relates to a readily available emergency filter mask, which may be impregnated with a liquid through which the wearer may breath, and incorporates a miniature source of light (flashlight) to enable the wearer to see in a darkened atmosphere.

2. Discussion of the Relevant Art

There are many dangerous situations today where it is necessary to filter the air which is inhaled by human beings. Generally, the filtration is primarily concerned with the removal of small particles of matter, which may be composed of dirt particles or gases such as smoke, which must be filtered from the air in order for a person to be able to breath for short periods of time.

The purpose of the present emergency safety mask is to provide protection to a user thereof for short periods of time if he or she should be caught in a emergency situation, such as a smoke filled room, to enable an individual wearer to escape from the environment in which he may temporarily be caught.

The emergency safety mask includes components which are small enough to be placed in a woman's pocketbook, a desk drawer, or in a man's jacket pocket or attache case, so that they may be readily be available when needed. The porus material utilized in the temporary emergency safety mask may consist of a washcloth, a man's handkerchief, or any other material suitable for absorbing liquid and permitting the atmosphere to pass therethrough.

U.S. Pat. No. 4,688,566 issued to Elvin L. Boyce on Aug. 25, 1987, discloses a form-fitting filter mask having a single band to affix it to the head of a user, and relies on the form-fitting shape over the chin of the user to close out the surrounding atmosphere. U.S. Pat. No. 3,985,132 issued to Boyce et al. on Oct. 12, 1976, here again describes and provides for a form fitting mask with two bands, suitable for fitting around the head of a user, and allows for more spacing around the nose and mouth of a user.

The shortcomings in the prior art do not provide for an emergency a safety mask which uses materials that are readily available to an individual on short notice.

The instant invention overcomes the shortcomings found in the prior art by providing the necessary materials, which may be purchased in a simple kit form and may be kept in close proximity to a user for use in an emergency.

OBJECTS OF THE INVENTION

The object of the present invention is to provide an emergency safety face mask, which is small in size and suitable for use by an individual.

It is another object of the present invention to provide an emergency safety face mask which can readily absorb moisture, and therefore permit protection in a smoke-filled room.

It is yet another object of the present invention to provide an emergency safety face mask, which includes the use of a light source to enable a person to see where he is going in attempting to escape from a dangerous environment.

It is still yet another object of the present invention to provide a small, handy emergency face mask, which may utilize conventional materials and may include as part of the mask an emergency light source and a protective liquid disposed in a frangible container.

SUMMARY OF THE INVENTION

An emergency safety face mask, according to the principles of the present invention, includes a flexible porus material capable of readily absorbing liquids and passing air therethrough. The material is generally rectangularly shaped to cover the nose, mouth, and chin of a user, having an upper portion and a lower portion. An elongated elastic member generally formed as the letter "X" is joined at the intersection thereof. An affixing member is disposed on the distal ends of the arms of the elongated elastic device, two of the arms are adapted to be affixed to the flexible porus material on the upper portion, and two of the arms are adapted to be affixed to the flexible porus material in the lower portion, so as to form a flexible circularly-shaped band adapted to be placed over the head of a user. A first clip device removably retains a miniature source of light (flashlight) and is mounted on one of the upper portion affixing devices, and a second clip means removably retains a frangible liquid container disposed on the other of said upper portion affixing devices.

The foregoing and other obvious advantages will appear from the description to follow. In the description, reference is made to the accompanying drawing, which forms a part hereof, and in which is shown by way of illustration a specific embodiment in which the invention may be practiced. This embodiment will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWING

In order that the invention may be more fully understood, it will now be described, by way of example, with reference to the accompanying drawing in which.

DESCRIPTION OF THE PREFERRED EMBODIMENT

Figure 1:
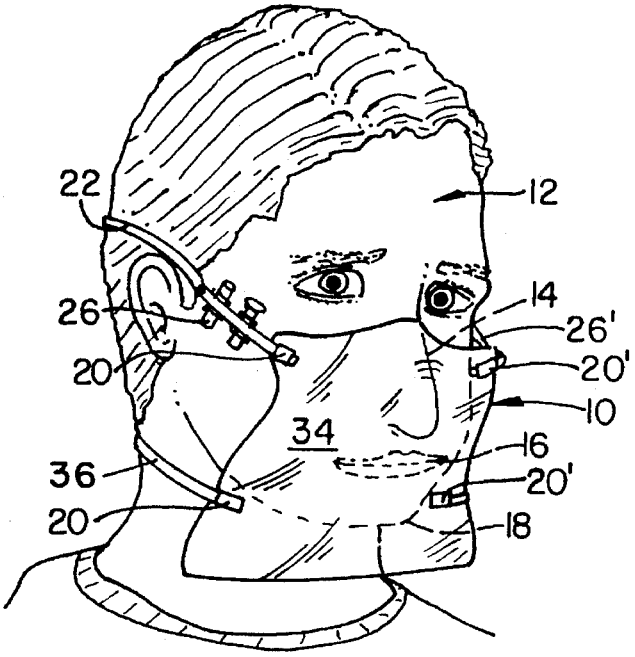
FIG. 1 is a pictorial representation of an emergency safety mask, according to the principles of the present invention, disposed on a user thereof.
Figure 2:
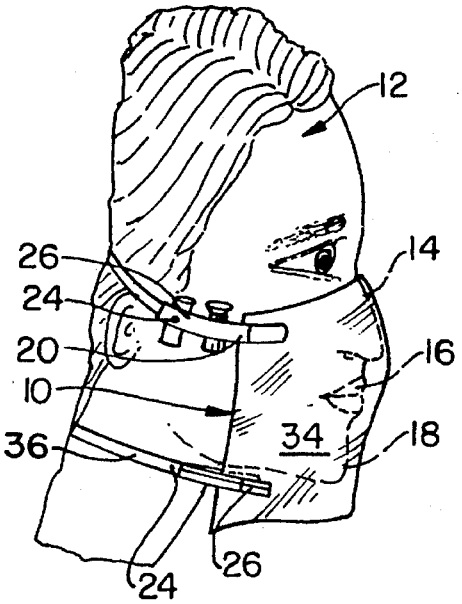
FIG. 2 is a pictorial representation of a side view of a user having the safety mask affixed thereon.

Referring now to the figures, and in particular to FIGS. 1 and 2, there is shown an emergency safety mask 10, according to the principles of the present invention, disposed over the face of a user 12, covering the user's nose 14, mouth 16, and pulled tautly over the user's chin 18, which is held in place by affixing devices 20 and 20', which are identical in configuration and are affixed to an elastic member 22, preferably by means of a rivet or eyelet 24.

Figure 4:
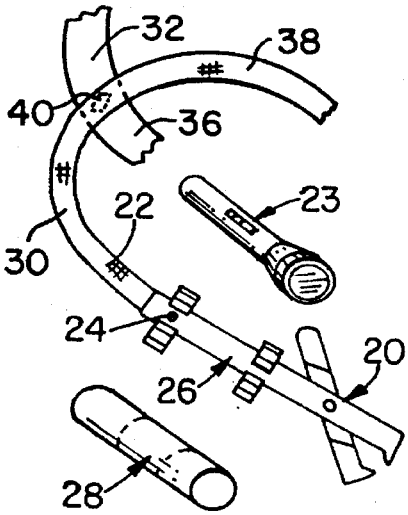
FIG. 4 is an exploded top plan view of the affixing device and clip member affixed on a reduced portion of the elastic member with a light source and frangible container adapted to be inserted into the clip member.

The affixing device 20 is similar to a well-known battery cable clip, and has affixed thereon a clip member 26 suitable for removably retaining a miniature flashlight 23. Affixing device 20' and clip member 26' made in the same manner as affixing device 20 and clip member 26, is suitable for retaining a frangible liquid container 28 therein, as shown in FIG. 4, which is an exploded partial view of one distal end portion of the elastic member 22. Alternatively, the affixing device 20 may also be a fabricated Velcro pad, which has a mating pad affixed to the soft porus material 34. The Velcro pad may be affixed by means of sewing, or riveting or eyeletting, as described hereinafter.

Figure 3:
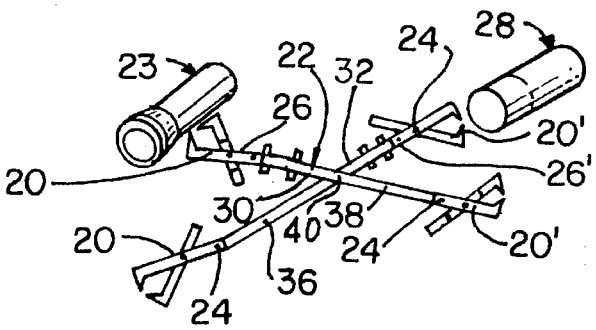
FIG. 3 is a front view of the elastic member showing the affixing devices and the clip members disposed thereon.

Referring now to FIG. 3, there is shown the elastic member 22 having four arms 30, 32, 36, and 38, fabricated in an "X" configuration with the center crossover 40 being stitched, in a conventional manner. Two of the arms 30 and 32 have disposed on the distal ends thereof the affixing means 20 and 20' onto which are also disposed clip members 26 and 26' which are held to the arms 30 and 32 of elastic member 22 by means of rivets or eyelets 24 (see FIG. 4). Affixing devices 20 and 20' are adapted to be affixed to the upper portion of a flexible porus material 34 capable of readily absorbing liquids and adapted to permit air to pass therethrough. The lower portion of the porus material 34 of the face mask 10 has affixed thereon the lower arms 36 and 38 of the elastic member 22 by means of affixing devices 20 and 20' so that the porus material 34 is pulled tightly over the chin 18 of the user 12. The porus material 34 may be a typical wash cloth or handkerchief, which is readily made available to the user by carrying it in his or her pocketbook or jacket or pants pocket.

It will be understood that various changes in the details, materials, arrangement of parts and operating conditions which have been herein described and illustrated in order to explain the nature of the invention may be made by those skilled in the art within the principles and scope of the instant invention.

In operation, if the different elements of the emergency safety mask have been purchased as a kit packet, it may readily be removed from its container, and the affixing means 20 and 20' may be affixed on the corners of a generally rectangular shaped porus material 34 and placed over the head of a user, with the flashlight contained in the clip member 26. The frangible liquid container 28 may be broken, with the liquid being poured over the porus material 34 where it is completely absorbed, thus providing a filter for the atmosphere when breathed by the user. The lower arms 20 and 20' are affixed on the lower portion on the porus material 34, so that the material is pulled tautly against the chin 18 of the user.

If the assembly has not been purchased in a kit form, one may readily apply the clip member to a handy washcloth or towel or, as stated earlier, a handkerchief, which is readily available.

Hereinbefore has been disclosed an emergency safety mask with a frangible liquid container for providing a liquid to the porus material and has associated therewith a miniature source of light to help the user escape from a darkened area.

Having thus set forth the nature of the invention, what is claimed is:

1. An emergency safety mask, comprising:

a) a flexible porus material capable of readily absorbing liquids and passing air therethrough, said material being generally rectangularly-shaped to cover the nose, mouth and chin of a user and having an upper portion and a lower portion;

b) elongated elastic means formed as the letter "X" having four arms and joined at the intersection thereof;

c) affixing means disposed on the distal ends of said four arms of said elongated elastic means, two of said arms being affixed to said flexible porus material on said upper portion and two of said arms being affixed to said flexible porus material on said lower portion so as to form a flexible circularly-shaped band for placement over the head of a user;

d) first clip means for removably retaining a miniature source of light mounted on one of said upper portion affixing means; and e) second clip means for removably retaining a frangible liquid container on the other of said upper portion affixing means.

2. An emergency safety mask according to claim 1, wherein said flexible porus material is fabricated from cotton woven to increase its ability to absorb liquids.

3. An emergency safety mask according to claim 1, wherein said affixing means comprises clamp means removably affixed to said flexible porus material.

4. An emergency safety mask according to claim 1, wherein said affixing means comprises Velcro means adapted to cooperate with cooperating means disposed on said flexible porus material.

5. An emergency safety mask according to claim 1, wherein said first and said second clip means comprises:

a) a generally U-shaped member having two arms and a connecting portion with an aperture disposed in said connecting portion; and b) rivet means received into said connecting portion aperture for retaining said U-shaped member to said elastic means.

6. An emergency safety mask according to claim 1, wherein said first and said second clip means comprises:

a) a generally U-shaped member having two arms and a connecting portion having an aperture disposed in said connecting portion; and b) rivet means received into said connecting portion aperture for retaining both said U-shaped member and said affixing means to said elastic means.

7. An emergency safety mask, comprising:

a) a flexible porus material fabricated from cotton woven to increase its ability to absorb liquids and passing air therethrough, said material being generally rectangularly-shaped to cover the nose, mouth and chin of a user and having an upper portion and a lower portion;

b) elongated elastic means generally formed as the letter "X" having four arms and joined at the intersection thereof;

c) clamp means removably affixed to said flexible porus material disposed on the distal ends of said four arms of said elongated elastic means, two of said four arms being affixed to said flexible porus material on said upper portion and two of said arms affixed to said flexible porus material on said lower portion so as to form a flexible circularly-shaped band for placement over the head of a user; and d) first and second clip means, each said first and second clip means including a generally U-shaped member having two arms and a connecting portion having an aperture disposed in said connecting portion and rivet means received into said connecting portion aperture for retaining said U-shaped member to said elastic means, said first clip means removably retaining a miniature source of light mounted on one of said upper portion affixing means and said second clip means removably retaining a frangible liquid container on the other of said upper portion affixing means.

8. An emergency safety mask, according to claim 7, wherein both said clip means and said affixing means are simultaneously attached to said elastic means by said rivet means.

* * * * *